US008566997B2

(12) United States Patent
Ramos Valcarce-Morcillo et al.

(10) Patent No.: US 8,566,997 B2
(45) Date of Patent: Oct. 29, 2013

(54) SELF DRAINING MOP SYSTEM

(76) Inventors: Miguel Angel Ramos Valcarce-Morcillo, Santa Marta de Tomes (ES); Jose Maria Iglesias Dominguez, Alagon del Caudillo (ES)

( * ) Notice: Subject to any disclaimer, the term of this patent is extended or adjusted under 35 U.S.C. 154(b) by 1465 days.

(21) Appl. No.: 11/568,186

(22) PCT Filed: Apr. 20, 2005

(86) PCT No.: PCT/ES2005/000207
§ 371 (c)(1),
(2), (4) Date: Oct. 15, 2009

(87) PCT Pub. No.: WO2005/101955
PCT Pub. Date: Nov. 3, 2005

(65) Prior Publication Data

US 2011/0209297 A1 Sep. 1, 2011

(30) Foreign Application Priority Data

Apr. 21, 2004 (ES) ..... P200400997

(51) Int. Cl.
*A47L 13/20* (2006.01)

(52) U.S. Cl.
USPC ..... 15/119.1; 15/228

(58) Field of Classification Search
USPC ..... 15/228, 119.1, 229.1–229.9, 260, 15/120.1, 120.2
See application file for complete search history.

(56) References Cited

U.S. PATENT DOCUMENTS 6,675,426 B2 * 1/2004 Ohm et al. ..... 15/119.2
2003/0167589 A1 * 9/2003 Dingert et al. ..... 15/260

* cited by examiner

*Primary Examiner* — Laura C Guidotti
(74) *Attorney, Agent, or Firm* — Jeffrey Furr, Esq.; Furr Law Firm

(57) ABSTRACT

The mop has a hollow pole (1) the center of which has a piston (3) which is activated from the outside with a movable grip (6), so that said piston (3) may reduce the elevation of a pressure chamber (4) established in the lower area of the pole (1), which communicates directly with a push cylinder (10) with a larger diameter, which reinforces said pole at the bottom and in the center of which works a push plunger (13) which supports the head (24) the mop cloth (25), also actuating said push plunger (13) on a pair of side cams (16) which when resting adjust on the exterior to the push cylinder (12) but that in the initial downward movement phase of the plunger (13) they tilt outward locking into a perimeter tab (18) of the wringer opening (19) also part of the opening of the bucket that holds the water, so that the tendency of the pole (1) reversing during the wringing phase is eliminated by locking said pole (1) to the wringer (19) using the mentioned tab (18) of the latter. The manual effort needed to wring the mop cloth (25) is therefore drastically reduced.

8 Claims, 4 Drawing Sheets

SELF DRAINING MOP SYSTEM

OBJECT OF INVENTION

This invention refers to a mop, which means a cleaning tool, such as those used to wash floors and which consist of mop cloth or an actual cleaning tool, part of a pole with an appropriate length so that the user may work while standing, a tool that is complemented with a bucket provided which has a mesh wringer at its opening and generally barrel-shaped, on which the water from the mop cloth is eliminated with pressure and turning same against the wringer, moved using the pole of the mop.

The object of the invention is to obtain a mop that allows to wring its mop cloth with minimal effort by the user of the product.

The invention is therefore in the area of cleaning tools, particularly at the household level.

BACKGROUND OF INVENTION

As is already known, when normally using a mop, the operation of wringing the mop is frequently repeated, inserting the mop into the wringer and simultaneously performing a rotating movement at the same time, which brings noticeable effort both at the level of the wrist and the arm as well as the backbone by the person who is doing the cleaning.

In an attempt to alleviate this pushing and twisting effort, elastic wringers are known to be used, which as the user pushes the mop into the wringer it tends to close, attempting to squeeze the mop cloth of the mop as much as possible.

There are also devices known to have handles where a pressure handle deforms the mop cloth and wrings same, but like in the above example and even when there is a positive effect, the effort by the person using the mop is still considerable.

The lever systems also present the additional problem that the user loses his/her natural position and ease, having to bend to activate said lever.

SUMMARY

The mop proposed by the invention makes up a noticeable technological advance in this field, upon obtaining that the wringing of the mop cloth can be made with minimal effort.

For that purpose and more specifically said mop, since it is conventional and key feature it incorporates a pole with a mop cloth, with an appropriate length to allow the user to work while standing, it focuses its characteristics in the fact that at the center of the mentioned hollow pole, it includes a rod with a mobile grip at the end, which can be moved axially over the pole, said rod is reinforced at the bottom by a piston, which establishes an air lock for a pressure chamber set in the center of the pole and under said piston, the bottom of the mentioned chamber extends in the lower extremity of the pole, to configure a push cylinder on which there is a plunger to where only the mop cloth is attached, and is movable so that it may later be replaced when needed.

Said push plunger, in addition to acting as a means for the mop cloth to move also actuates on a pair of cams, placed in diameter and mounted tilted on the wall of the cylinder itself so that said cams that laterally adapt to the push cylinder when resting, tilt outward at the start of handling the movement of the plunger, locking itself on a tab that slightly squeezes the opening of the wringer, with which the pole assembly remains immobilized during the tendency of the upward movement of same which occurs with the pressure of the mop cloth against the wringer, so that all of the energy applied by the user is harnessed for the wringing itself, with minimal effort given the difference in diameters between the pressure chamber installed in the center of the pole and the diameter of the push cylinder, an effort which supposes a long trajectory of the movable grip, for a short but sufficient trajectory of the push plunger.

According to characteristics of the invention, another provision is that at the bottom end of the push plunger it has a blind and axial hole, with a flare at the bottom, intended to receive and attach the head of the mop cloth, which occurs in a cap equipped with two axial spindles, one at the top, affected by a diameter cut and with a perimeter shoulder to interlock at the bottom of the axial hole and blind of the pushing plunger, while the bottom part also has an expansion on its free end to attach the mop, strands or cloth that make up the actual mop, with the help of a washer, with the special feature that the mentioned cap includes a pair of pins pointing upward on its lower part, in front of the respective cams, so that when there is an ascending traction on the moving grip of the mop, or when it tends to move upward due to a recovery or return spring, the mentioned pins act first over the cams by unlocking them from the internal perimeter tab of the wringer's opening.

DESCRIPTION OF DRAWINGS

To complement this description and with the object of helping to better understand the characteristics of the invention, according to a preemptive example of the practical execution of same, we attach as an integral part of said description, a set of drawings which illustrate but are not limited to representing the following.

PREFERABLE EXECUTION OF THE INVENTION

Figure 1:
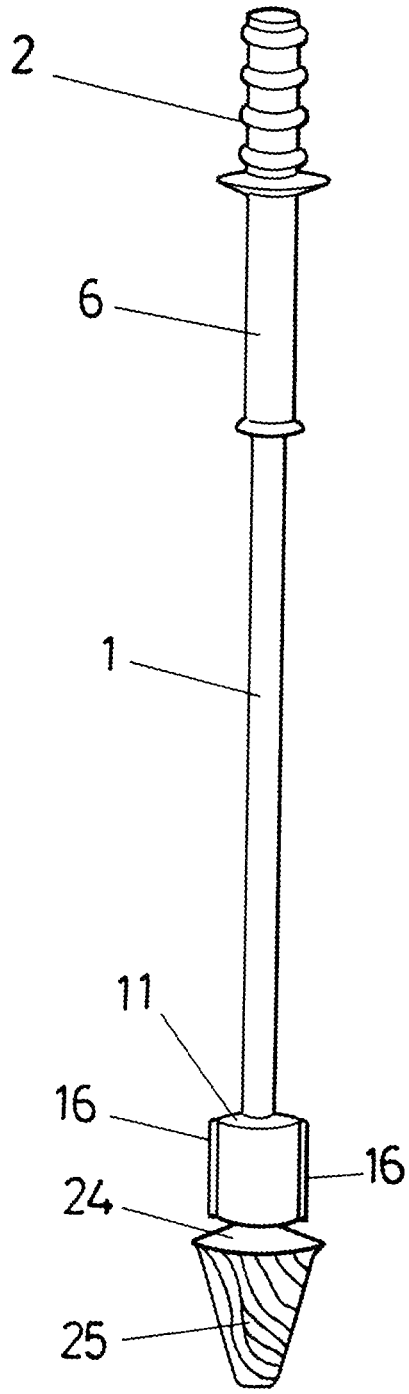
FIG. 1.—Shows, according to a schematic representation a side view, a mop made according to the object of this invention.
Figure 2:
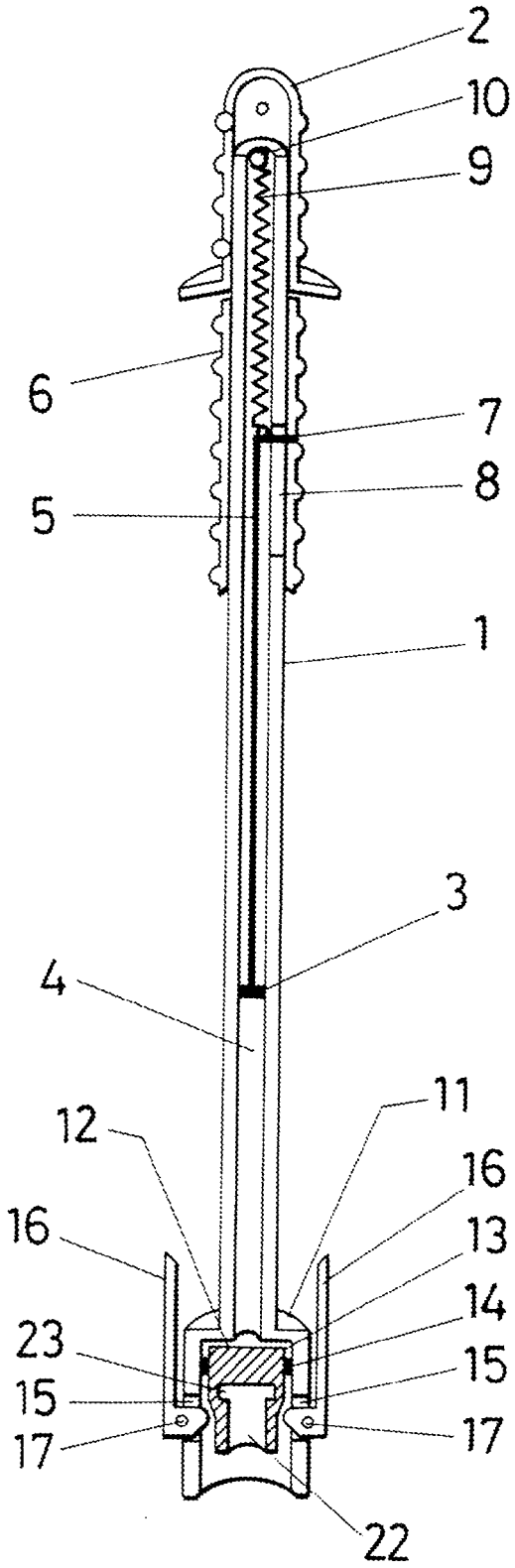
FIG. 2.—Shows, according to a side elevation and diameter view, the mop from the above figure without the mop cloth.

By viewing the mentioned figures it is evident how the recommended mop consists of a hollow pole (1), that closes at the top end with a handle or handgrip (2), conveniently attached to same, inside the space of said pole (1) there is a piston (3), under which there is a pressure chamber (4), which will be described below, and said piston (3) is supported by a rod (5) that is directed towards the top end of the pole and can be moved with a movable grip (6), mounted on the outside and sliding over the pole (1), as can be perfectly seen in FIG. 2, the rod (5) works together with the movable grip (6) with a pin (7) which actuates in the center of a groove (8) on the pole (1) itself, the length of which determines the range of axial movement provided for the piston (3).

This pin (7) also acts as a means of attaching a return spring (9) to the bottom end, set between said pin and the top end (10) of the pole, for example with the combination of another pin.

The pole (1) is reinforced at the bottom end by a push cylinder (11), with a considerably wider diameter, for a chamber (12) also with a larger diameter than the chamber (4), the chamber (12) in which a push plunger (13) is used and which is assisted by at least one tight joint (14) that ensures the tightness of all chambers (4) and (12).

On the side wall of the push cylinder, below the operating area of the tight joint (14), there are two windows (15) in which each cam (16) actuate tightly, diametrally opposed, mounted tilted on the respective axles (17) inserted in said windows (15), with the mentioned push plunger (13) having a front side operation on said cams (16) at the start of its trajectory.

These cams (16), in the said initial phase of the movement of the push plunger (13), tilt outward so as to interlock into a ring or tab in the inside perimeter (18) provided at the opening of the wringer (19), so that after this start in the ascending movement into the push plunger (13) the cams (16) lock the pole (1) completely in the mentioned perimeter tab (18) of the wringer, which eliminates the tendency to move the pole upward due to the wringing pressure and said pole (1) is rigidly joined to the wringer (19).

Figure 3:
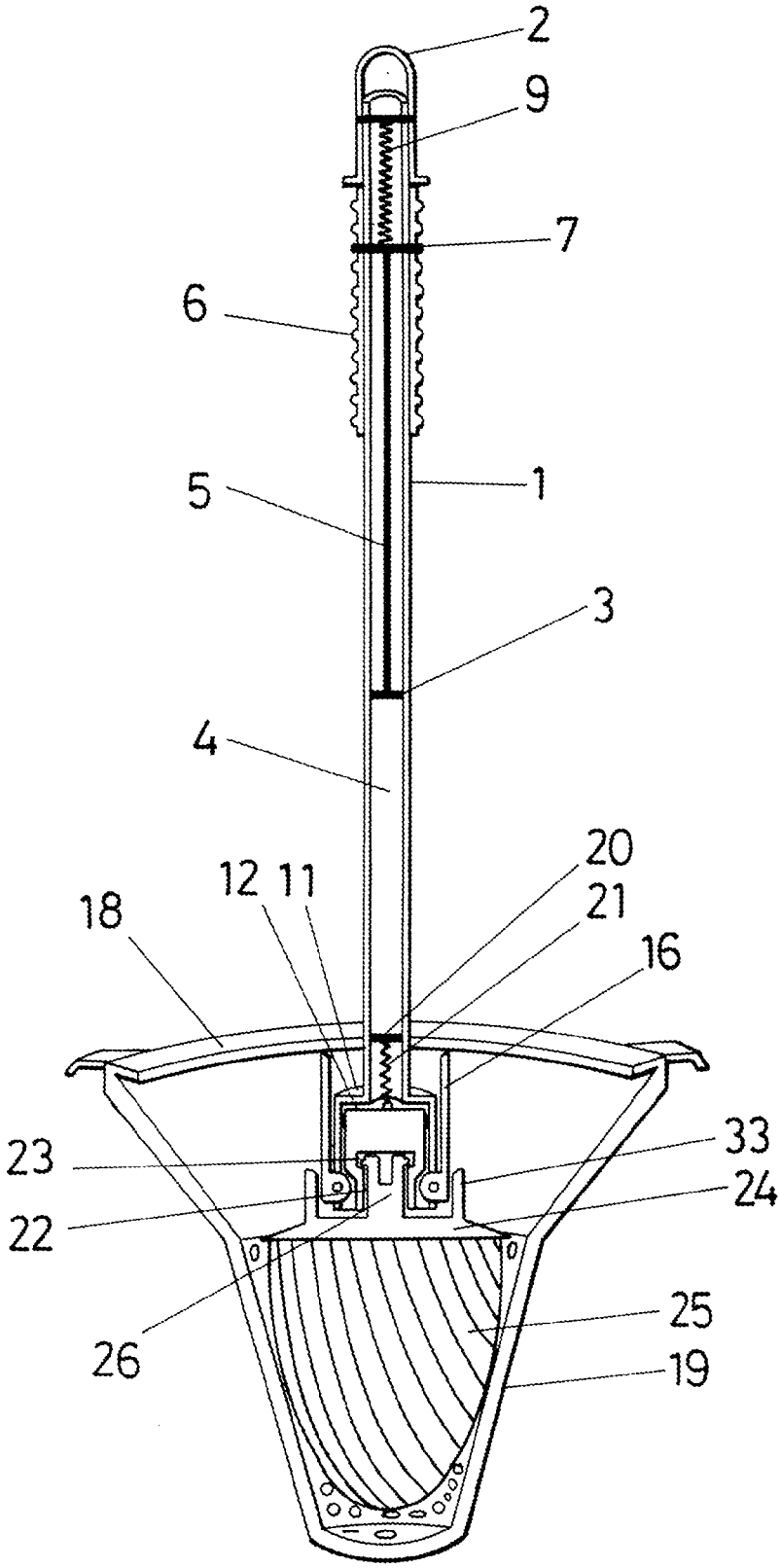
FIG. 3.—Shows a similar view as FIG. 2, but it also shows the mop cloth and its wringer.
Figure 4:
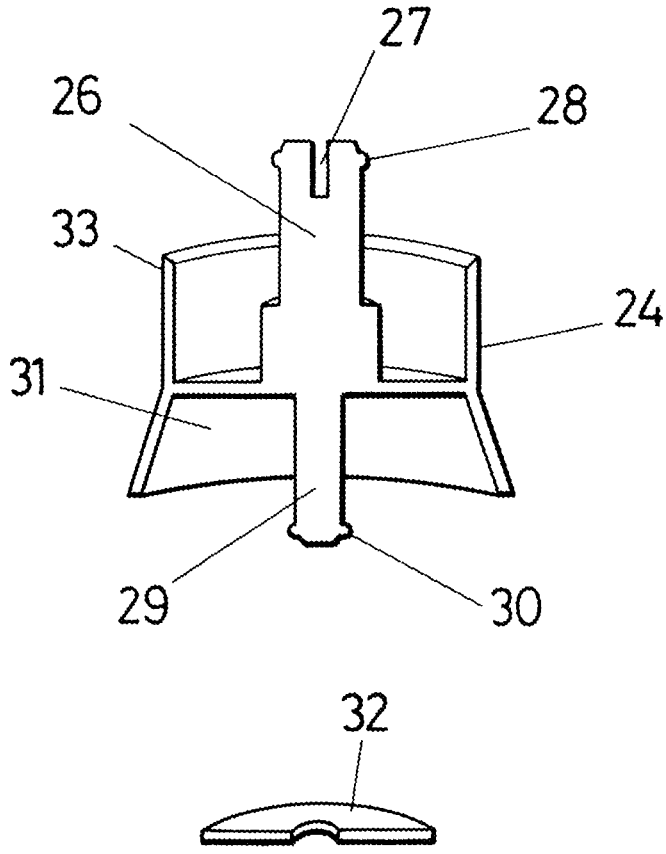
FIG. 4.—Finally shows a detailed view of the diameter section of the head of the mop cloth.

According to the variance in performing FIG. 3, it is feasible to house in the pressure chamber (4) a second piston (20) that is part of the push plunger (13) with a spring (21) which works when compressed.

In any case, the push plunger (13) has included at its lower end a blind and an axial hole (22), with a perimeter flare at the bottom (23), to receive and attach the head (24) of the actual mop or mop cloth (25). In this sense each head (24) has two axial rods, one top rod (26), with a diameter cut (27) on its free extremity and a perimeter nerve (28) to interlock during the expansion (23) of the blind and axial hole (22) of the push plunger (13), so that the mentioned diametral cut (27) allows for elastic deformation, specifically the radial contraction, of said rod (26) so that it may cross the lower and narrower area of the blind hole (22). The lower rod (29), also reinforced by its free extremity in a perimeter nerve (30), is made to attach the mop, which remains partially snapped in a type of inverted bucket (31) on the head, and finally held with a washer (32).

The head (24) includes at the top and side a pair of ascending pins (33), and diametrally opposed, operationally facing the cams (16), so that when said head (24) starts the upward movement, it acts on said cams (16) causing these to unlock with respect to the perimetral tab (18) of the wringer (19), which allows the mop to be removed from said wringer.

Finally it should be indicated that the pressure chamber (4) may be occupied with air, water or any other type of gas or liquid, and that the movable grip (4) may be replaced by a push-button that acts on a mechanical and/or electric pump, as well as the attachment of the head (24) of the mop to the push plunger (13), this may also be done using an interior or exterior screwed joint, as long as in limit situations of the assembly of the pins (33) they remain facing the cams (16).

We claim:

1. A Device comprising:

a wringer attached to an opening of a water bucket, and a pole reinforced on its lower end with a cloth mop or squeegee, where said pole (1) is hollow and its interior has a piston (3) that is activated with an exterior movable grip (6), axially movable on the pole itself (1), setting itself under the mentioned piston (3) an upper pressure chamber (4) that connects directly with a lower chamber (12) established in a push cylinder (11), with a larger diameter reinforcing a lower extremity of the pole (1), also impacting a center of the lower chamber (12) and with a larger diameter a push plunger (13) and where the lower chamber (12) remains confined by a tight joint (14) set between the push plunger (13) and a chamber wall, where the joint under which a pair of window (15) are established, diametrally opposed, where a pair of cams (16) tilt forward and back, which when resting on an exterior adjust to the push cylinder (11) are activated by the push plunger (13) tilting outward to lock into a perimeter tab (18) added to an opening of the wringer (19).

2. A device, according to claim 1, further comprising having the piston (3) which confines the upper pressure chamber (4) at the top and supports an ascending rod (5), which is reinforced on its free and top extremity with a cross pin (7), which emerges on the outside of the pole (1) through a longitudinal groove (8) and is supported by the movable grip (6).

3. A device, according to claim 1, comprising where the piston (3) in the upper pressure chamber (4) are activated by a pump.

4. A device, according to claim 1, further comprising having a head (24) being attached to the push plunger (13) with an interior or exterior groove system.

5. A device, according to claim 4, further comprising having the head (24) having at the top and in ascending from a pair of pins (33) that are diametrally opposed, operationally facing the cams (16) and that act on the latter in the initial ascending movement of the pole (1), releasing said cams (16) from the perimeter tab (18) of the wringer opening (19).

6. A device, according to claim 4, further comprising having the head (24) of a mop cloth (25) coupled to a lower, axial and blind hole (22) of the push plunger (13), with a flare at the bottom (23), using a top and axial rod (26), with a diameter cut (27) and where said rod has a perimetral shoulder (28) to attach to the flare (23) on the bottom of the blind hole (22), and said head (24) has another axial and lower rod (29), to attach the mop cloth (25) in the center of an inverted bucket (31), equipped at its free end with a perimetral shoulder (30) to pressure couple a support washer (32).

7. A device, according to claim 1, further comprising having in the upper pressure chamber (4) a second piston (20)) with a spring (21) that is part of the push plunger (13) where the spring (21) acts when compressed.

8. A device, according to claim 1, further comprising having the upper pressure chamber (4) and the lower chamber (12) may be filled with a liquid or a gas.

* * * * *